US009201396B2

(12) United States Patent
Uehara

(10) Patent No.: US 9,201,396 B2
(45) Date of Patent: Dec. 1, 2015

(54) IMAGE FORMING APPARATUS WITH IMPROVED HEAT DISCHARGE

(71) Applicant: KYOCERA Document Solutions Inc., Osaka (JP)

(72) Inventor: Masakazu Uehara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/630,630

(22) Filed: Feb. 24, 2015

(65) Prior Publication Data

US 2015/0248084 A1 Sep. 3, 2015

(30) Foreign Application Priority Data

Feb. 28, 2014 (JP) ..... 2014-039099

(51) Int. Cl.
*G03G 15/20* (2006.01)
*G03G 21/20* (2006.01)
*G03G 15/00* (2006.01)

(52) U.S. Cl.
CPC ..... *G03G 21/206* (2013.01); *G03G 15/2017* (2013.01)

(58) Field of Classification Search
CPC ..... G03G 15/2025
USPC ..... 399/92, 406, 322
See application file for complete search history.

(56) References Cited

U.S. PATENT DOCUMENTS 5,070,373 A * 12/1991 Fukano et al. ..... 399/322
7,865,122 B2 * 1/2011 Koyama et al. ..... 399/92
8,554,104 B2 * 10/2013 Shimoyama et al. ..... 399/92
8,909,088 B2 * 12/2014 Murooka ..... 399/92
8,965,239 B2 * 2/2015 Kaino et al. ..... 399/92
2002/0085856 A1 * 7/2002 Kuwabara ..... 399/92
2010/0329726 A1 * 12/2010 Kasuga ..... 399/92
2014/0219674 A1 * 8/2014 Asami
2014/0341607 A1 * 11/2014 Nakano et al. ..... 399/92

FOREIGN PATENT DOCUMENTS

JP 09090855 A * 4/1997
JP 10143053 A * 5/1998
JP 11015357 A * 1/1999
JP 2003162165 A * 6/2003
JP 2004-109168 A 4/2004
JP 2012073335 A * 4/2012

OTHER PUBLICATIONS

Nishida et al., "Image Forming Device", JP11-015357, Jan. 22, 1999, JPO Machine English Translation of Detailed Description, Description of Drawings, Effect of Invention.*

* cited by examiner

*Primary Examiner* — Susan Lee
(74) *Attorney, Agent, or Firm* — Stein IP, LLC

(57) ABSTRACT

High-temperature heat generated from a fixing device is efficiently discharged to an outside an apparatus. A printer includes: a photosensitive drum; a transfer roller; a fixing device; and a duct frame that is mounted between two side plates disposed to oppose each other and disposed right over the fixing device with a lower surface opened. An upper inner surface of the duct frame is inclined in a short-edge direction of the duct frame, and an inclined upper end portion of the upper inner surface is provided with an aperture portion that discharges heat generated from the fixing device to an outside of the duct frame.

10 Claims, 14 Drawing Sheets

IMAGE FORMING APPARATUS WITH IMPROVED HEAT DISCHARGE

INCORPORATION BY REFERENCE

The present application is based on and claims the benefit of priority from Japanese Patent Application No. 2014-039099 filed on Feb. 28, 2014, the contents of which are hereby incorporated by reference.

BACKGROUND

The present invention relates to an image forming apparatus that fixes a toner image transferred to a sheet to the sheet by thermocompression bonding, more particularly, to a technology that discharges heat generated in an apparatus to an outside of the apparatus.

In an image forming apparatus that fixes a toner image transferred to a sheet to the sheet by thermocompression bonding, during a printing period, the sheet is heated to one hundred and tens of degrees by a fixing device, so that the toner forming the toner image is melted and the toner image is fixed to the sheet. Because of this, high-temperature heat, which is generated from the fixing device during a continuous sheet feeding period, stays in the apparatus.

FIG. 14 is a left side sectional view showing a structure near a conventional fixing device. A duct frame 55, which is mounted between two side plates (not shown) disposed to oppose each other and a lower surface is opened, is disposed right over a fixing device 9. The fixing device 9 includes a heat roller 9*a* heated by a heater and a pressure roller 9*b* pressed against the heat roller 9*a*. High-temperature heat 100 generated from the fixing device 9 moves to an upper inner surface 55*a* of the duct frame 55 and goes to a state to stay in the duct frame 55. Because of this, the duct frame 55 must be composed of a heat-resistant resin to prevent the duct frame 55 from being deformed by the heat, which is a cause of cost increase. To solve this problem, for example, an image forming apparatus is already proposed, in which a fan 60 is disposed right before a sheet delivery portion 50 that delivers a sheet, on which a toner image is fixed, to outside; and the high-temperature heat generated from the fixing device 9 is discharged to the outside of the apparatus to cool an inside of the apparatus.

According to the conventional image forming apparatus described above, there is a problem that indeed the heat moving to a downstream side beyond the fixing device in a conveyance direction is discharged to the outside of the apparatus; but the heat moving to an upstream side beyond the fixing device 9 in the conveyance direction stays in the apparatus. If the heat stays in the apparatus, the apparatus is likely to fall into a malfunction state. Besides, it becomes essential to dispose a fan; accordingly, the cost increases. Further, also electric power for operating the fan and the operation sound become problems.

SUMMARY

An image forming apparatus according to an aspect of the present disclosure includes:
an image carrier on a surface of which a toner image is developed; a transfer device that transfers the toner image from the image carrier to a sheet; a fixing device that fixes the toner image to the sheet by heating and pressing the sheet to which the toner image is transferred; and a duct frame that is mounted between two side plates disposed at respective sides which interpose the fixing apparatus and is disposed right over the fixing apparatus with a lower surface opened; wherein an upper inner surface of the duct frame is inclined upward when seeing from the side, and an inclined upper end portion of the upper inner surface is provided with an aperture portion that discharges heat generated from the fixing device to an outside of the duct frame.

Besides, an image forming apparatus according to an aspect of the present disclosure includes:
an image carrier on a surface of which a toner image is developed; a transfer device that transfers the toner image from the image carrier to a sheet; a fixing device that fixes the toner image to the sheet by heating and pressing the sheet to which the toner image is transferred; and a duct frame that is mounted between two side plates disposed at respective sides which interpose the fixing apparatus and is disposed right over the fixing apparatus with a lower surface opened; wherein an upper inner surface of the duct frame is inclined in a direction extending toward the side; and any one of the two side plates is provided with an aperture portion that exposes at least an open-side end surface of the duct frame.

Besides, an image forming apparatus according to an aspect of the present disclosure includes: an image carrier on a surface of which a toner image is developed; a transfer device that transfers the toner image from the image carrier to a sheet; a fixing device that fixes the toner image to the sheet by heating and pressing the sheet to which the toner image is transferred; and a duct frame that is mounted between two side plates disposed at respective sides which interpose the fixing apparatus and is disposed right over the fixing apparatus with a lower surface opened; wherein an upper inner surface of the duct frame is inclined upward in a direction extending toward the side and in a direction extending upward when seeing from the side; and any one of the two side plates is provided with an aperture portion that exposes at least an open-side end surface of the duct frame.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
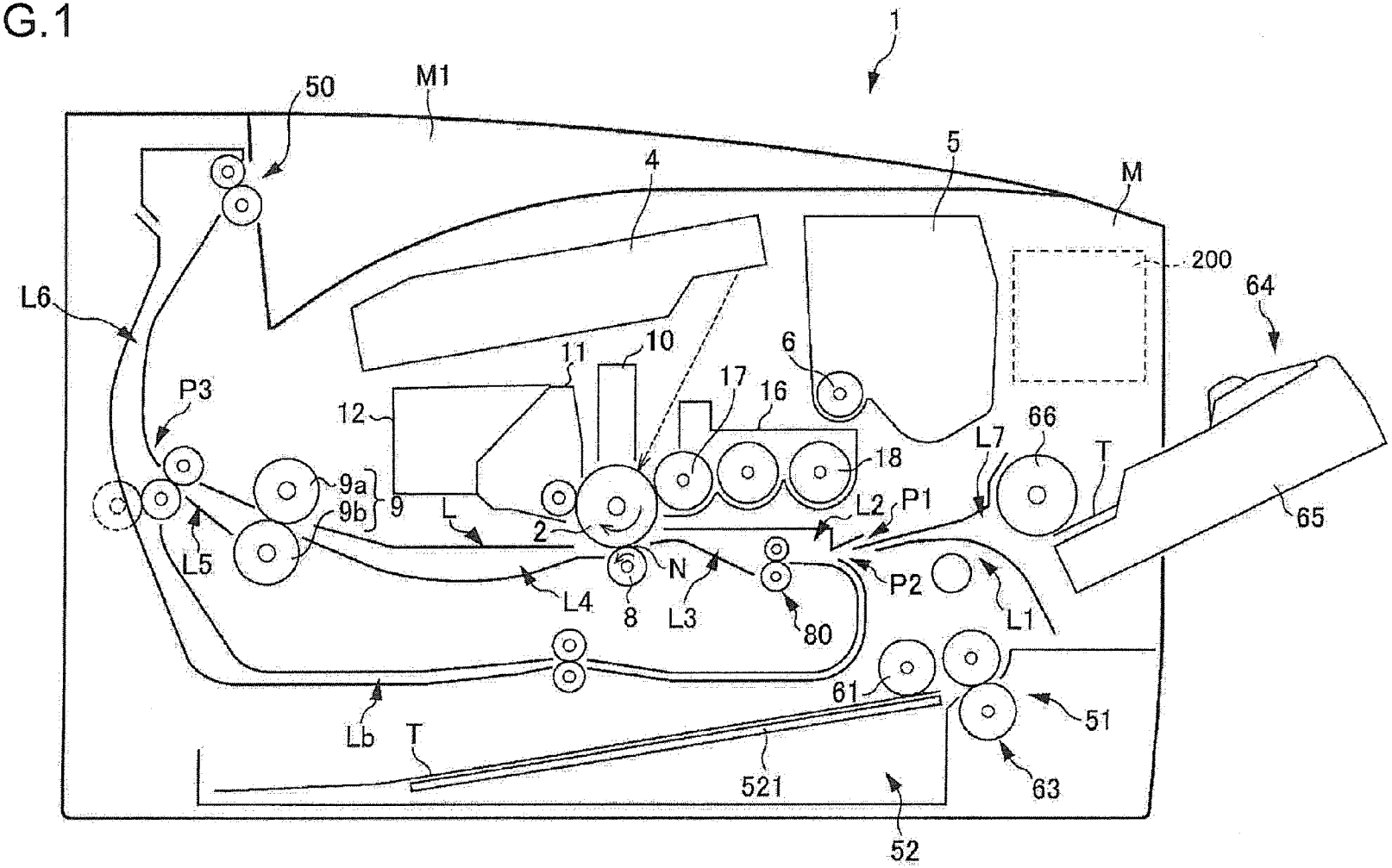
FIG. 1 is a left side sectional view showing a structure of an image forming apparatus according to an embodiment of the present disclosure.

Hereinafter, an image forming apparatus according to an embodiment of the present disclosure is described with reference to drawings. FIG. 1 is a left side sectional view for describing disposition of each component of a printer 1 as the image forming apparatus according to the embodiment of the present disclosure. In the present embodiment, a side (right side of FIG. 1) where a manual feeding tray 65 described later is disposed is a front side of the printer 1.

The printer 1 has: a housing M; an image forming portion that forms a predetermined image on a sheet (transferred material) T based on predetermined image information; and a sheet feeding delivery portion that feeds the sheet T to the image forming portion and delivers the sheet T on which the image is formed.

As shown in FIG. 1, the image forming portion includes a photosensitive drum 2, an electrifying portion 10, a laser scanner unit 4, a developing device 16, a toner cartridge 5, a toner supplying device 6, a transfer roller 8, a fixing device 9, and a drum cleaning device 11. Besides, the sheet feeding delivery portion includes a sheet feeding cassette 52, a manual feeding tray 65, a pair of registration rollers 80, and a conveyance path L for the sheet T.

The photosensitive drum 2 is formed of a cylindrical member and functions as an image carrier. The photosensitive drum 2 is disposed in the housing M in a rotatable manner about a rotating shaft perpendicular to FIG. 1. An electrostatic latent image is formed on a surface of the photosensitive drum 2.

The electrifying portion 10 is disposed over the photosensitive drum 2. The electrifying portion 10 electrifies evenly positively (positive polarity) the surface of the photosensitive drum 2.

The laser scanner unit 4 is disposed above the photosensitive drum 2 with a space from the photosensitive drum 2. The laser scanner unit 4 is composed to include a not-shown laser light source, a polygonal mirror, a motor for driving the polygonal mirror and the like.

The laser scanner unit 4 scans the surface of the photosensitive drum 2 for light exposure based on image information output from external apparatuses such as a PC (personal computer) and the like. By being scanned and exposed by the laser scanner unit 4, electric charges electrified on the surface of the photosensitive drum 2 are removed. In this way, an electrostatic latent image is formed on the surface of the photosensitive drum 2.

The developing device 16 is disposed in front (right side of FIG. 1) of the photosensitive drum 2. The developing device 16 develops a monochromatic (usually black) toner image on the electrostatic latent image formed on the photosensitive drum 2. The developing device 16 is composed to include a developing roller 17 arrangeable to oppose the photosensitive drum 2 and a stirring roller 18 for stirring toner.

The toner cartridge 5 stores toner to be supplied to the developing device 16.

The toner supplying device 6 supplies toner stored in the toner cartridge 5 to the developing device 16.

The drum cleaning device 11 is disposed behind (left side of FIG. 1) the photosensitive drum 2. The drum cleaning device 11 removes toner and affixes remaining on the surface of the photosensitive drum 2. A wasted toner portion 12 for accumulating the toner removed by the drum cleaning device 11 is disposed adjacently to the fixing device 9 in an upstream side of the fixing device 9 in a conveyance direction.

The transfer roller 8 functions as a transfer device that transfers a toner image developed on the surface of the photosensitive drum 2 to the sheet T. A transfer bias is applied to the transfer roller 8 by a not-shown voltage applying device such that the toner image developed on the photosensitive drum 2 is transferred to the sheet T.

The transfer roller 8 contacts and leaves the photosensitive drum 2. Specifically, the transfer roller 8 is composed to movable between a butting position where to be made to butt the photosensitive drum 2 and a leaving position where to be located away from the photosensitive drum 2. In detail, the transfer roller 8 is moved to the butting position in a case where the toner image developed on the photosensitive drum 2 is transferred to the sheet T and moved to the leaving position in other cases.

The sheet T is sandwiched by the photosensitive drum 2 and the transfer roller 8, and pushed against the surface (side where the toner image is developed) of the photosensitive drum 2. In this way, a transfer nip N is formed and the toner image developed on the photosensitive drum 2 is transferred to the sheet T.

The fixing device 9 melts the toner forming the toner image transferred to the sheet T and fixes the toner to the sheet T. The fixing device 9 includes a heat roller 9*a* heated by a heater and a press roller 9*b* pressed against the heat roller 9*a*. The heat roller 9*a* and the press roller 9*b* sandwich and convey the sheet T to which the toner image is transferred. The sheet T is sandwiched and conveyed by the heat roller 9*a* and the press roller 9*b*, whereby the toner transferred to the sheet T is melted and fixed. In the meantime, in the present embodiment, as described above, the fixing device 9 having the heat roller 9*a* and the press roller 9*b* is described as an example, but the fixing device 9 may have another structure, for example, a structure including a heat mechanism that is formed of a heat belt instead of the heat roller 9*a*.

The sheet feeding cassette 52 is disposed in a lower portion of the housing M. The sheet feeding cassette 52 is disposed on a front side (right side of FIG. 1) of the housing M to be drawable in a horizontal direction. The sheet feeding cassette 52 includes a placement plate 521 where the sheets T are placed, and the sheets T are stored in the sheet feeding cassette 52 with the sheets T stacked on the placement plate 521. A cassette sheet feeding portion 51 is disposed at a sheet feeding end portion (right end portion of FIG. 1) of the sheet feeding cassette 52. The cassette sheet feeding portion 51 sends out the sheets T stored in the sheet feeding cassette 52 to the conveyance path L.

The cassette sheet feeding portion 51 includes a double conveyance prevention mechanism that is composed of a feeding forward roller 61 that pulls out the sheets T placed on the placement plate 521 and a pair of rollers 63 that send out the sheets T one after another to the conveyance path L.

The conveyance path L for conveying the sheets T is formed between the cassette sheet feeding portion 51 or a manual sheet feeding portion 64 and the sheet delivery portion 50. The conveyance path L has: a first conveyance path L1 from the cassette sheet feeding portion 51 to a first joining portion P1; a second conveyance path L2 from the first joining portion P1 to the pair of registration rollers 80; a third conveyance path L3 from the pair of registration rollers 80 to the transfer roller 8; a fourth conveyance path L4 from the transfer roller 8 to the fixing device 9; a fifth conveyance path L5 from the fixing device 9 to a branch portion P3; a sixth conveyance path L6 from the branch portion P3 to the sheet delivery portion 50; and a seventh conveyance path L7 from the manual feeding tray 65 to the first joining portion P1.

The first joining portion P1 is a joining portion where the first conveyance path L1 for conveying the sheet T from the cassette sheet feeding portion 51 and the seventh conveyance path L7 for conveying the sheet T from the manual feeding tray 65 join each other.

A second joining portion P2 is disposed in the second conveyance path L2. Further, the conveyance path L has a backward conveyance path Lb from the branch portion P3 to the second joining portion P2. The second joining portion P2 is a joining portion where the second conveyance path L2 and the backward conveyance path Lb join each other.

Here, the pair of registration rollers 80 are disposed in an upstream side (right side of FIG. 1) of the transfer roller 8 in a conveyance direction of the sheet T. The pair of registration rollers 80 are a pair of rollers that are once butted by a tip end portion T1 of the sheet T fed from a sheet feeding roller 66 in a stop state, thereafter, driven and rotated to send out the sheet T to a downstream side in the conveyance direction. Besides, the pair of registration rollers 80 are a pair of rollers that perform skew (skew sheet feeding) correction of the sheet T and timing adjustment with respect to the toner image.

The backward conveyance path Lb is a conveyance path that is disposed to make an opposite surface (not-printed surface) of an already printed surface oppose the photosensitive drum 2 when performing both-side printing of the sheet T. By means of the backward conveyance path Lb, it is possible to put the sheet T, which is conveyed from the branch portion P3 toward the sheet delivery portion 50, back to the second conveyance path L2 with upside of the sheet T down. A predetermined toner image is transferred, by the photosensitive drum 2, to the not-printed surface of the sheet T reversed upside down by the backward conveyance path Lb.

The manual sheet feeding portion 64 is disposed on a front side (right side of FIG. 1) of the housing M and above the sheet feeding cassette 52. The manual sheet feeding portion 64 includes the manual feeding tray 65 that is a sheet placement portion and the sheet feeding roller 66 that is a sheet feeding roller.

As to the manual feeding tray 65, its base end portion is swingably (freely opened and closed) mounted near an entrance of the seventh conveyance path L7. The manual feeding tray 65 composes a portion of the front surface of the housing M in the closed state.

The sheet feeding roller 66 pulls out the sheet T placed on the manual feeding tray 65 and sends out the sheet T to the seventh conveyance path L7.

The manual sheet feeding portion 64 feeds the sheet T, which is placed on the manual feeding tray 65 in the opened state, to the second conveyance path L2 via the seventh conveyance path L7 and the first joining portion P1.

The sheet delivery portion 50 is formed at an end portion of the sixth conveyance path L6. The sheet feeding portion 50 is disposed in an upper side of the housing M. The sheet delivery portion 50 is opened toward the front (right of FIG. 1) of the housing M. The sheet delivery portion 50 delivers the sheet T, to which the toner is fixed by the fixing device, to an outside of the housing M.

A delivered sheet accumulation portion M1 is formed on the open side of the sheet delivery portion 50. The delivered sheet accumulation portion M1 is a portion that is formed of the upper surface of the housing recessed downward. A bottom surface of the delivered sheet accumulation portion M1 composes a portion of the upper surface of the housing M. The sheets T, which are delivered from the sheet delivery portion 50 and have the predetermined image transferred, are stacked and accumulated on the delivered sheet accumulation portion M1.

Hereinafter, structures, which efficiently discharge heat generated from the fixing device 9 to an outside of the apparatus, are described by presenting several embodiments.

First Embodiment

Figure 2:
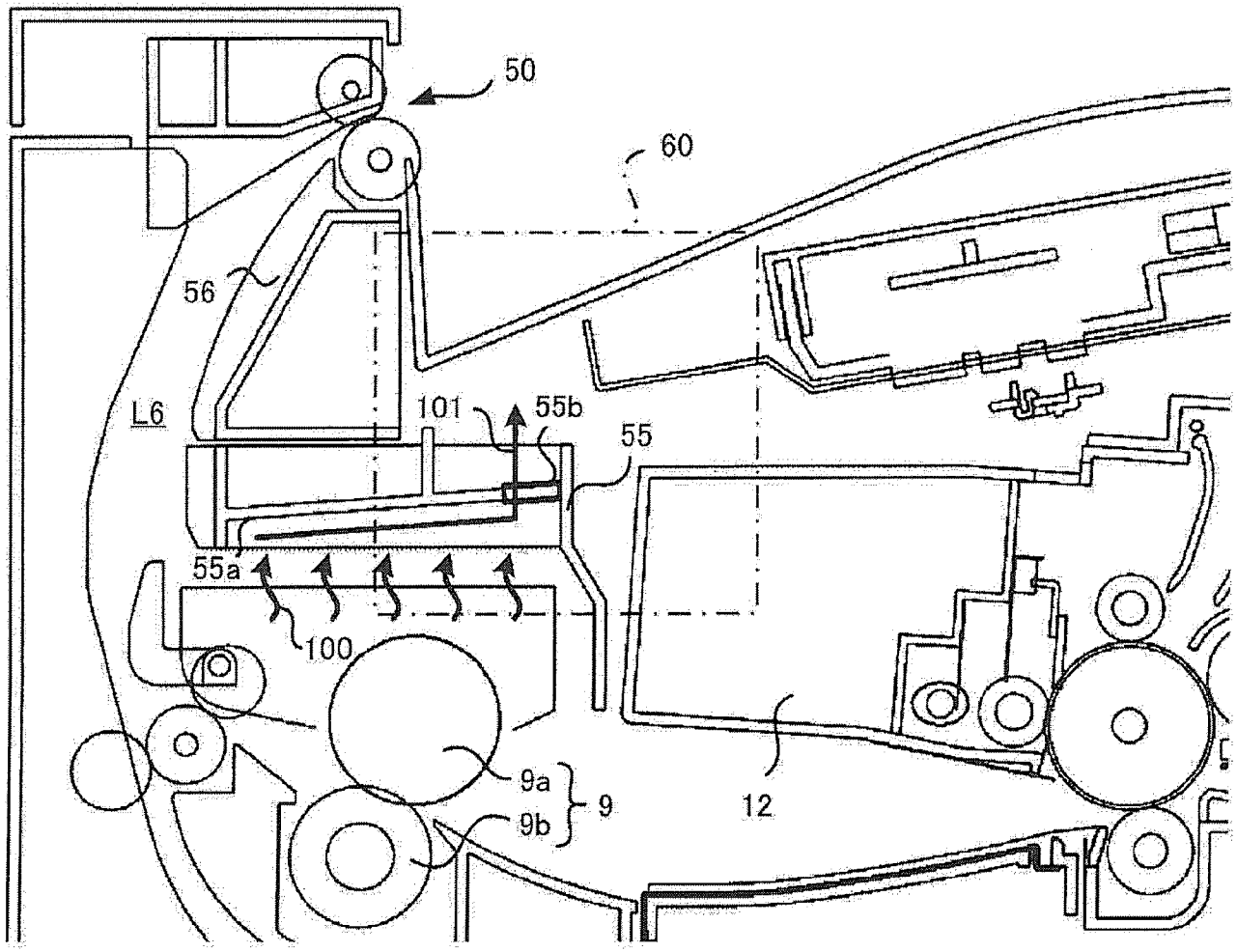
FIG. 2 is a left side sectional view showing a structure near a fixing device of an image forming apparatus according to a first embodiment.
Figure 3:
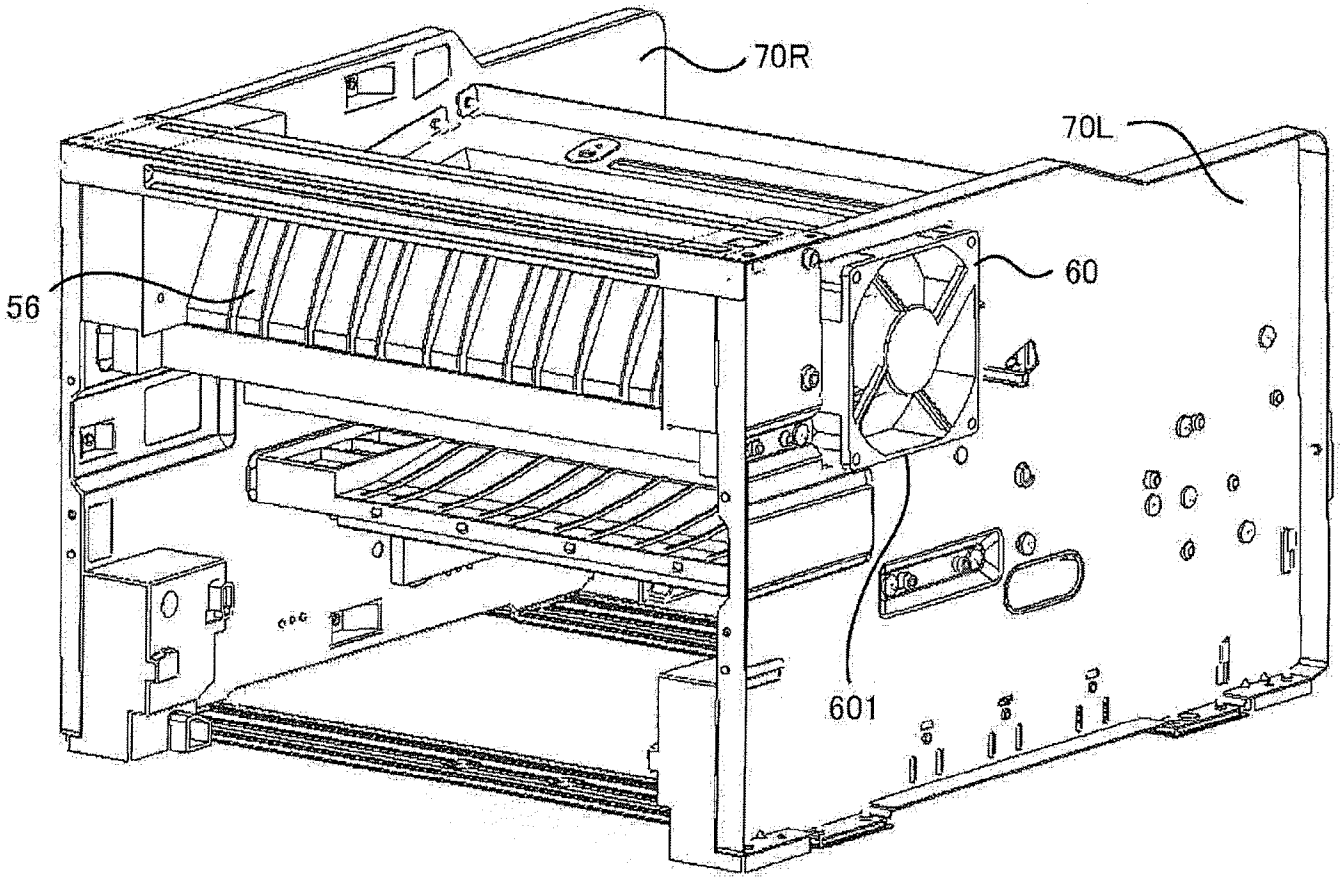
FIG. 3 is a perspective view of the image forming apparatus according to the first embodiment with the fixing device removed.
Figure 4:
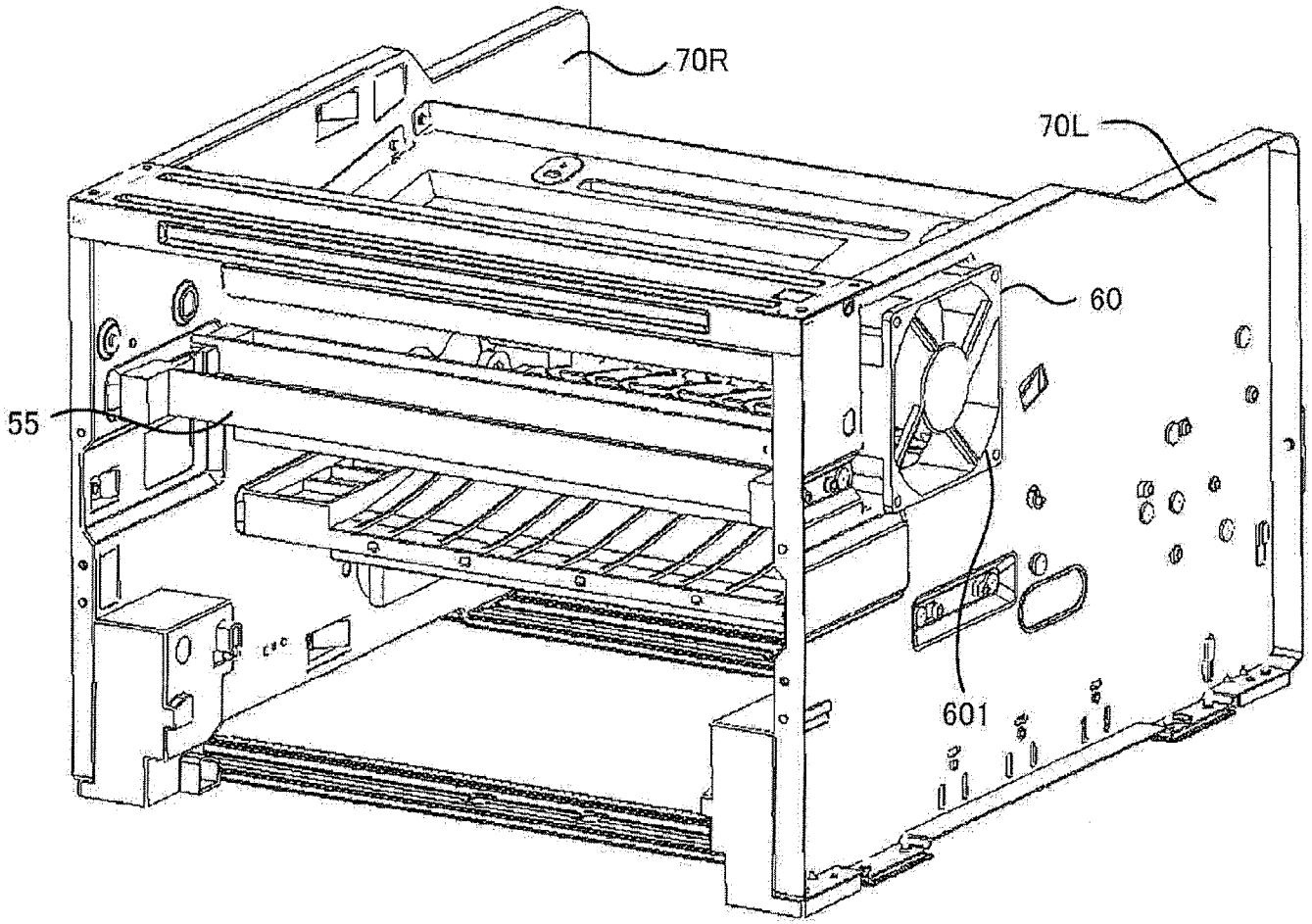
FIG. 4 is a perspective view of the image forming apparatus according to the first embodiment with a guide member removed further.

FIG. 2 is a left side sectional view showing a structure near the fixing device 9 of an image forming apparatus (printer 1) according to a first embodiment. FIG. 3 is a perspective view of the image forming apparatus (printer 1) according to the first embodiment with the fixing device 9 removed. FIG. 4 is a perspective view of the image forming apparatus (printer 1) according to the first embodiment with a guide member 56 removed further. The guide member 56 is a guide member on a bent inner side of the conveyance path L6, and disposed on an upper portion of a duct frame 55.

The duct frame 55 is formed of a resin, for example. The duct frame 55 is mounted between two side plates 70L, 70R that are disposed to oppose respective sides in a rotating shaft direction of the heat roller 9*a* and press roller 9*b* with the fixing device 9 interposed. The duct frame 55 is disposed right over the fixing device 9 and its lower surface is opened. An upper inner surface 55*a* of the duct frame 55 is inclined upward (in the side view of FIG. 2, a short-edge direction of the duct frame 55) when seeing from the rotating shaft direction, and specifically, inclined to rise toward the wasted toner portion 12.

An inclined upper end portion of the upper inner surface 55*a* of the duct frame 55 is provided with an aperture portion 55*b* from which heat 100 generated from the fixing device 9 is discharged to an outside of the duct frame 55. For example, it is possible to form the aperture portion 55*b* into a slit shape, and provide the inclined upper end portion of the duct frame 55 with the aperture portion 55*b* at several places in a long-edge direction of the duct frame 55, namely, in the rotating shaft direction.

In the meantime, in a case where the fixing device 9 does not have the heat roller 9*a* and the press roller 9*b*, for example, in a case where the fixing device 9 has another structure including a heat mechanism that is formed of a heat belt instead of heat roller 9*a*, the duct frame 55 is mounted between the two side plates 70L, 70R disposed at the respective sides that interpose the fixing device 9. Besides, the upper inner surface of the duct frame 55 is inclined upward when seeing from the side of the fixing device 9.

Besides, the side plate 70L is provided with an aperture portion 601 that exposes at least a side end surface of the inclined upper end portion of the upper inner surface 55*a* of the duct frame 55 and a side end surface of the wasted toner portion 12. A fan 60 is disposed in the aperture portion 601 of the side plate 70L. Instead of the side plate 70L, the side plate 70R may be provided with the same aperture portion and the fan 60.

According to the present embodiment, as shown by an arrow 101 of FIG. 2, the upper inner surface 55*a* of the duct frame 55 is inclined upward; accordingly, the heat 100 generated from the fixing device 9 moves obliquely upward along the upper inner surface 55*a* of the duct frame 55, and is discharged from the aperture portion 55*b* to the outside of the duct frame 55. And, by making outside air blow from a side surface of the printer 1 into the printer 1 by means of the fan 60 toward the aperture portion 55*b* and the wasted toner portion 12, or by exhaling air in the printer 1, it is possible to effectively cool the wasted heat from the aperture portion 55*b* and also cool the wasted toner portion 12.

Second Embodiment

Figure 5:
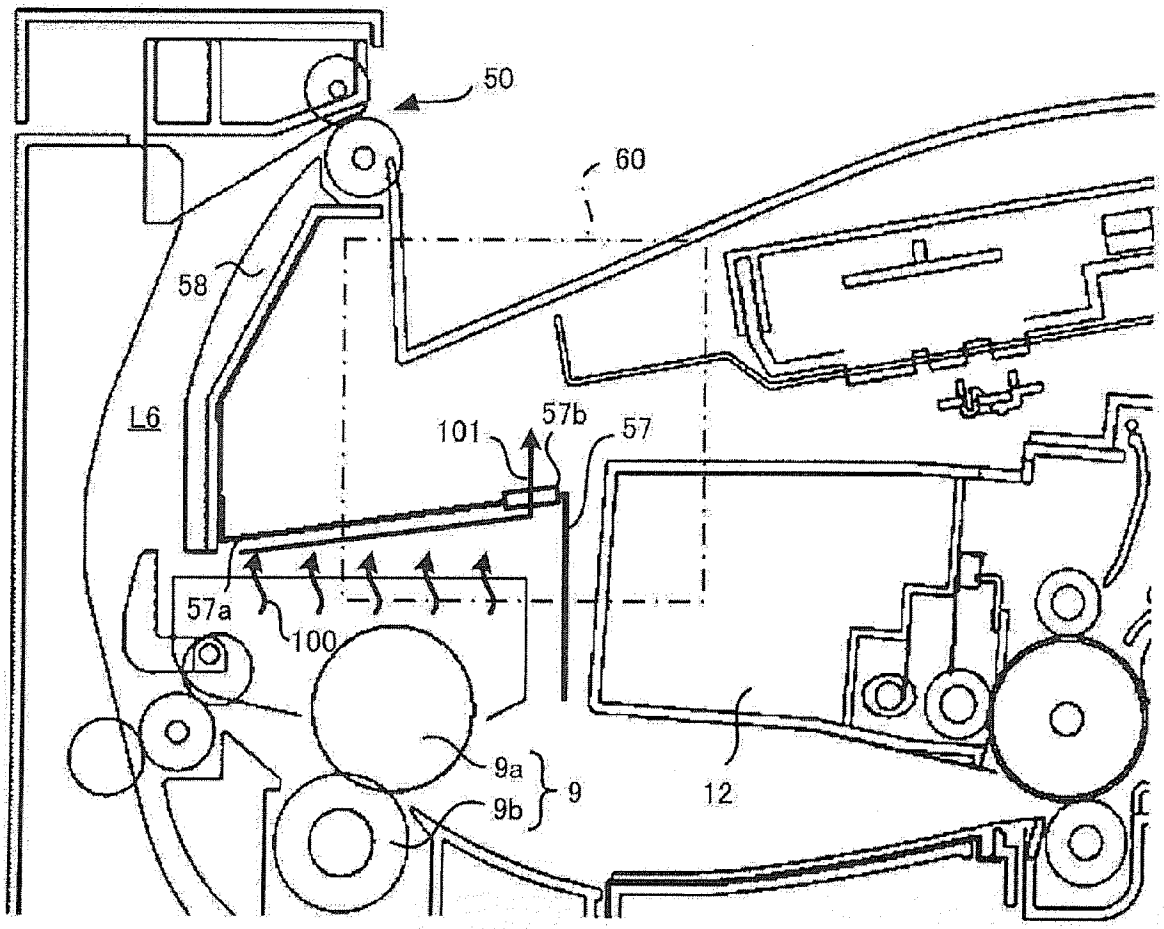
FIG. 5 is a left side sectional view showing a structure near a fixing device of an image forming apparatus according to a second embodiment.
Figure 6:
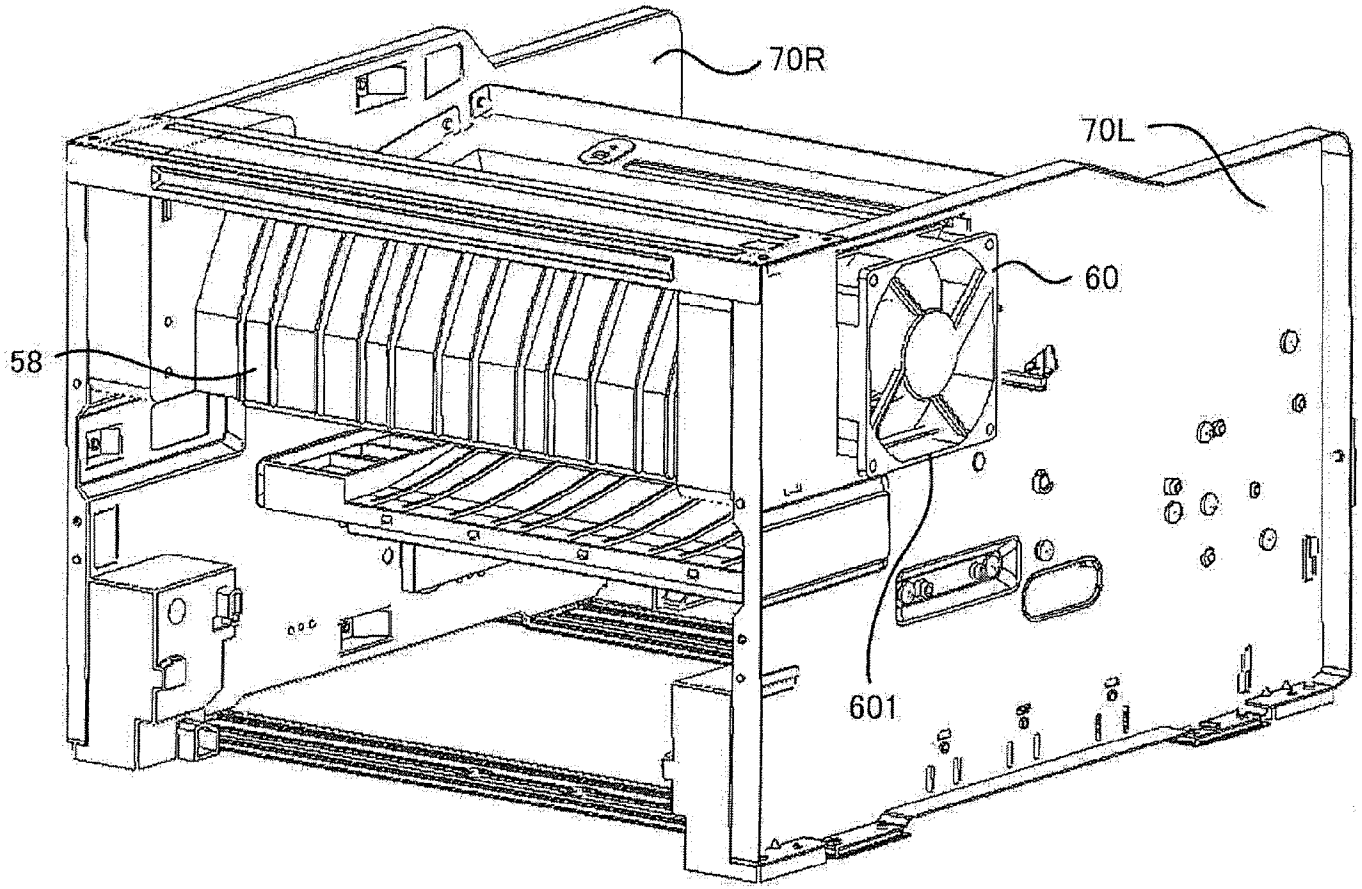
FIG. 6 is a perspective view of the image forming apparatus according to the second embodiment with the fixing device removed.
Figure 7:
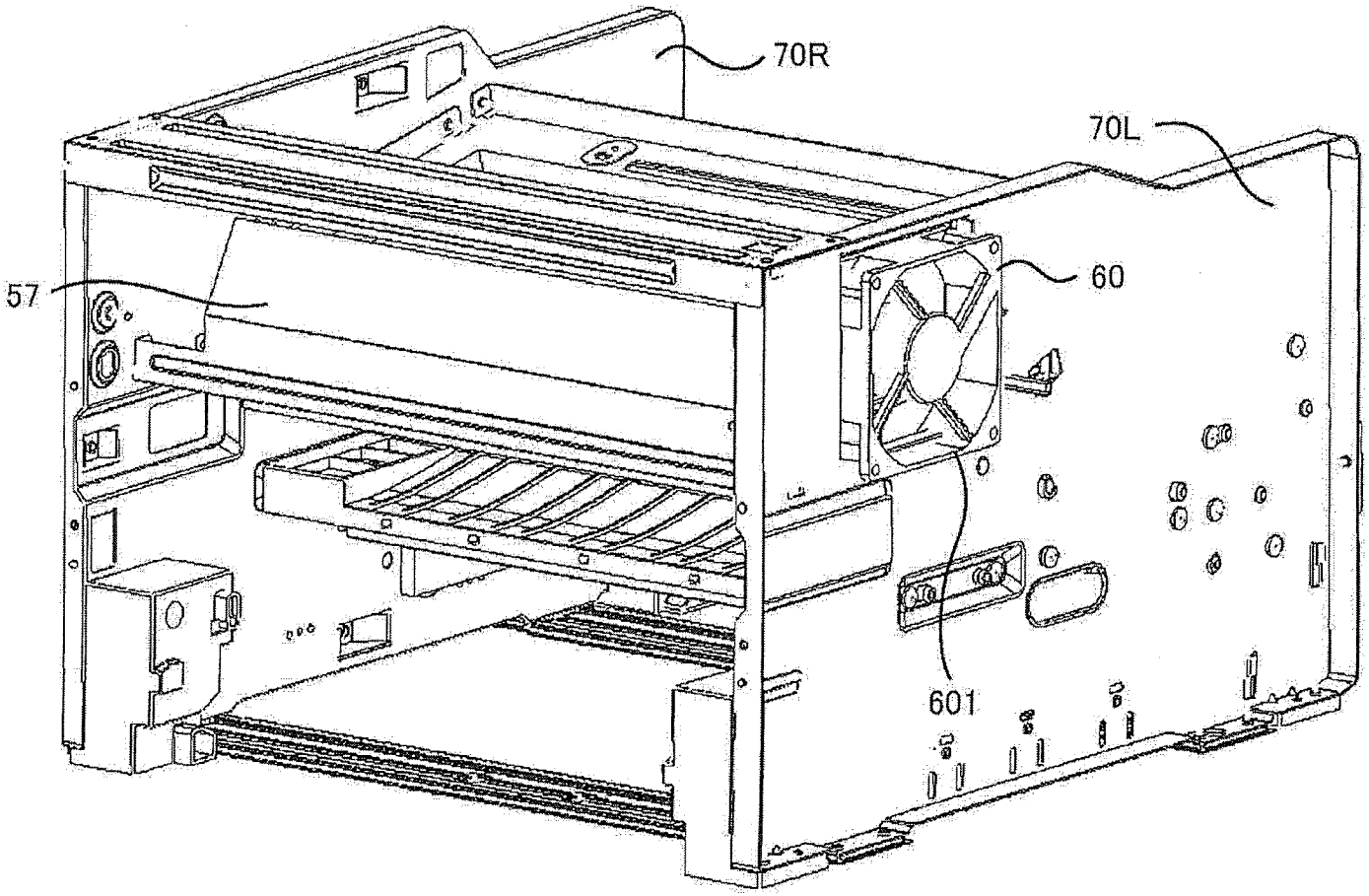
FIG. 7 is a perspective view of the image forming apparatus according to the second embodiment with a guide member removed further.

FIG. 5 is a left side sectional view showing a structure near the fixing device 9 of an image forming apparatus (printer 1) according to a second embodiment. FIG. 6 is a perspective view of the image forming apparatus (printer 1) according to the second embodiment with the fixing device 9 removed. FIG. 7 is a perspective view of the image forming apparatus (printer 1) according to the second embodiment with a guide member 58 removed further. The guide member 58 is a guide member on the bent inner side of the conveyance path L6, and disposed to cover an outer surface of a duct frame 57.

The duct frame 57 is formed of a sheet metal. The duct frame 57 is mounted between the two side plates 70L, 70R that are disposed to oppose the respective sides in the rotating shaft direction. The duct frame 57 is disposed right over the fixing device 9 and a lower surface is opened. An upper inner surface 57*a* of the duct frame 57 is inclined upward (in the side view of FIG. 5, a short-edge direction of the duct frame 57) when seeing from the rotating shaft direction, and specifically, inclined to rise toward the wasted toner portion 12.

An inclined upper end portion of the upper inner surface 57*a* of the duct frame 57 is provided with an aperture portion 57*b* from which the heat 100 generated from the fixing device 9 is discharged to an outside of the duct frame 57. For example, it is possible to form the aperture portion 57*b* into a slit shape, and provide the inclined upper end portion of the duct frame 57 with the aperture portion 57*b* at several places in a long-edge direction of the duct frame 57, namely, in the rotating shaft direction.

Besides, like in the first embodiment, the side plate 70L is provided with the aperture portion 601 that exposes at least a side end surface of the inclined upper end portion of the upper inner surface 57*a* of the duct frame 57 and the side end surface of the wasted toner portion 12. The fan 60 is disposed in the aperture portion 601 of the side plate 70L. Instead of the side plate 70L, the side plate 70R may be provided with the same aperture portion 601 and the fan 60.

According to the present embodiment, as shown by the arrow 101 of FIG. 5, the upper inner surface 57*a* of the duct frame 57 is inclined upward; accordingly, the heat 100 generated from the fixing device 9 moves obliquely upward along the upper inner surface 57*a* of the duct frame 57, and is discharged from the aperture portion 57*b* to the outside of the duct frame 57. And, by making outside air blow from the side surface of the printer 1 into the printer 1 by means of the fan 60 toward the aperture portion 57*b* and the wasted toner portion 12, or by exhaling air in the printer 1, it is possible to effectively cool the wasted heat from the aperture portion 57*b* and also cool the wasted toner portion 12. Further, the duct frame 57 is formed of a sheet metal; accordingly, heat radiation effect rises higher than the first embodiment that uses the duct frame 55 formed of a resin, and it is possible to raise cooling efficiency higher.

Third Embodiment

Figure 8:
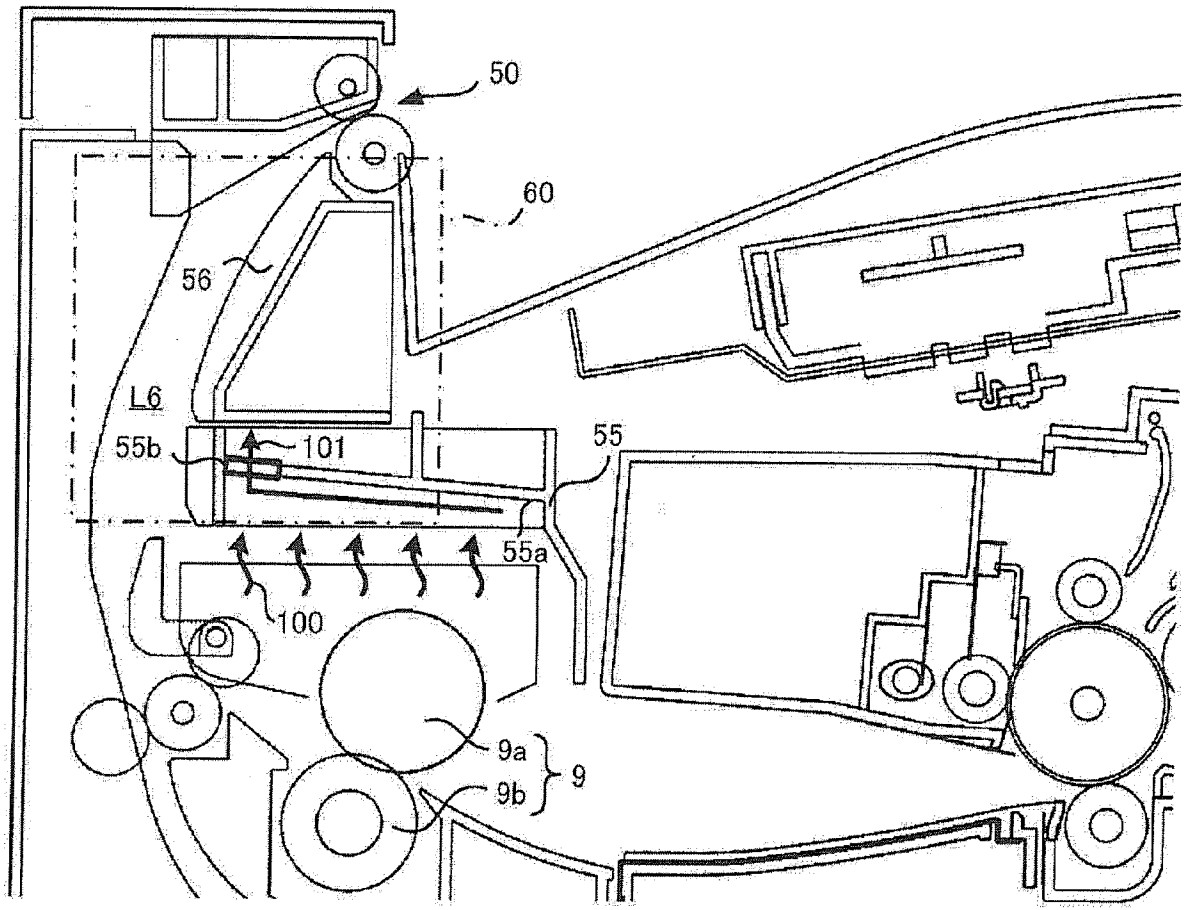
FIG. 8 is a left side sectional view showing a structure near a fixing device of an image forming apparatus according to a third embodiment.

FIG. 8 is a left side sectional view showing a structure near the fixing device 9 of an image forming apparatus (printer 1) according to a third embodiment.

Like in the first embodiment, the duct frame 55 is formed of a resin, mounted between the two side plates (not shown) that are disposed to oppose each other, disposed right over the fixing device 9 and a lower surface is opened. The guide member 56 on the bent inner side of the sixth conveyance path L6 is disposed on the upper portion of the duct frame 55. In the third embodiment, the upper inner surface 55*a* of the duct frame 55 is inclined upward (the short-edge direction of the duct frame 55) when seeing from the rotating shaft direction, and specifically, inclined to rise toward the sixth conveyance path L6.

The inclined upper end portion of the upper inner surface 55*a* of the duct frame 55 is provided with the aperture portion 55*b* from which the heat 100 generated from the fixing device 9 is discharged to the outside of the duct frame 55. For example, it is possible to form the aperture portion 55*b* into a slit shape, and provide the inclined upper end portion of the duct frame 55 with the aperture portion 55*b* at several places in the long-edge direction of the duct frame 55, namely, in the rotating shaft direction.

Besides, like in the first and second embodiments, any one of the two side plates is provided with an aperture portion that exposes at least the side end surface of the inclined upper end portion of the upper inner surface 55*a* of the duct frame 55 and a side end surface of the sixth conveyance path L6. The fan 60 is disposed in the aperture portion of the side plate.

According to the present embodiment, as shown by the arrow 101 of FIG. 8, the upper inner surface 55*a* of the duct frame 55 is inclined upward; accordingly, the heat 100 generated from the fixing device 9 moves obliquely upward along the upper inner surface 55*a* of the duct frame 55, and is discharged from the aperture portion 55*b* to the outside of the duct frame 55. And, by making outside air blow from the side surface of the printer 1 into the printer 1 by means of the fan 60 toward the aperture portion 55*b* and the sixth conveyance path 6L, or by exhaling air in the printer 1, it is possible to effectively cool the wasted heat from the aperture portion 55*b*. Besides, it is also possible to cool the sixth conveyance path L6; accordingly, it is also possible to cool, at the same time, the sheet that is conveyed in the six conveyance path L6 and delivered from the sheet delivery portion 50.

Fourth Embodiment

Figure 9:
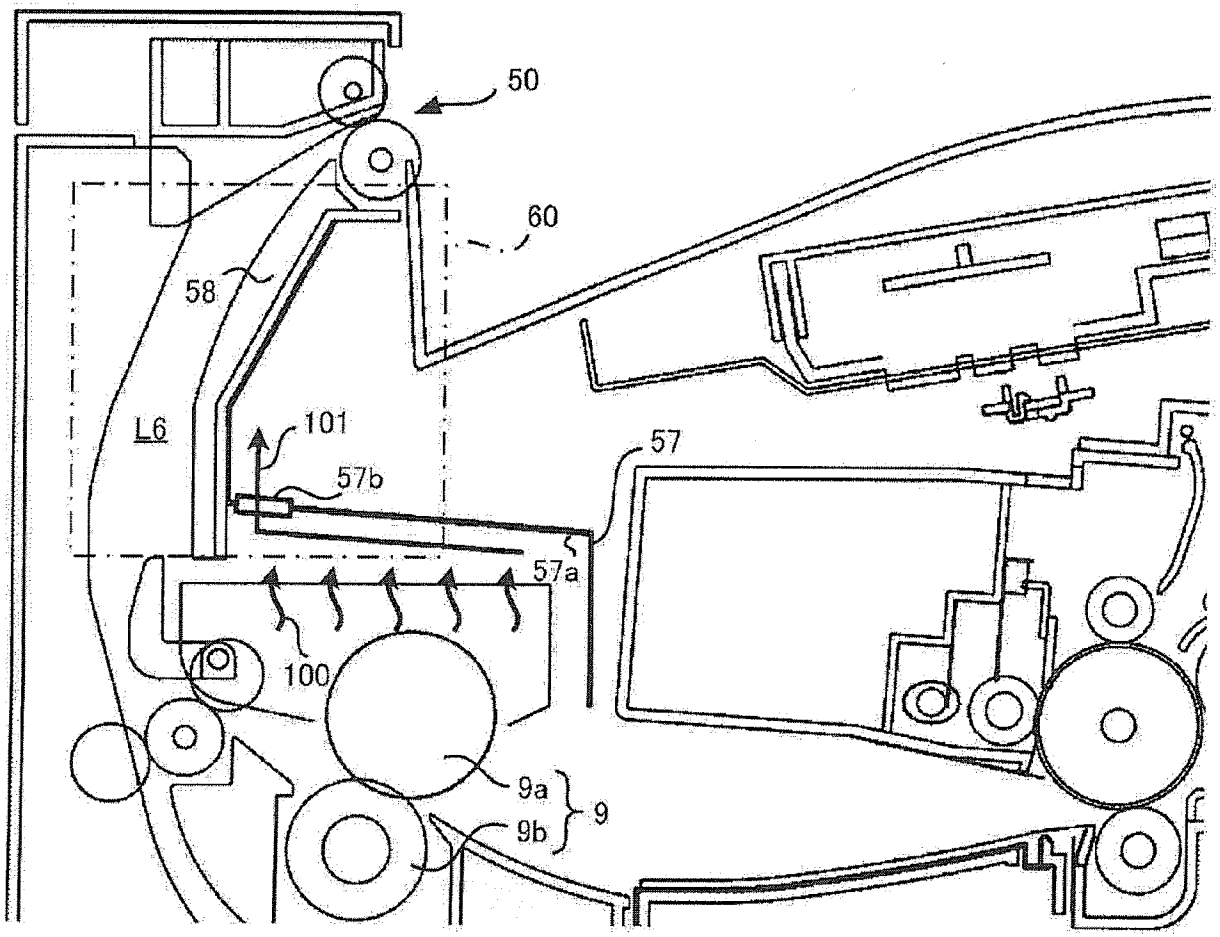
FIG. 9 is a left side sectional view showing a structure near a fixing device of an image forming apparatus according to a fourth embodiment.

FIG. 9 is a left side sectional view showing a structure near the fixing device 9 of an image forming apparatus (printer 1) according to a fourth embodiment.

The duct frame 57 is formed of a sheet metal. The duct frame 57 is mounted between the two side plates 70L, 70R that are disposed to oppose the respective sides in the rotating shaft direction. The duct frame 57 is disposed right over the fixing device 9 and the lower surface is opened. The upper inner surface 57*a* of the duct frame 57 is inclined when seeing from the rotating shaft direction, specifically, inclined to rise toward the wasted toner portion 12.

The inclined upper end portion of the upper inner surface 57*a* of the duct frame 57 is provided with the aperture portion 57*b* from which the heat 100 generated from the fixing device 9 is discharged to the outside of the duct frame 57. For example, it is possible to form the aperture portion 57*b* into a slit shape, and provide the aperture portion 57*b* at several places in the long-edge direction of the duct frame 57, namely, in the rotating shaft direction.

Besides, like in the first to third embodiments, any one of the two the side plates is provided with an aperture portion that exposes at least the side end surface of the inclined upper end portion of the upper inner surface 57*a* of the duct frame 57 and the side end surface of the sixth conveyance path 6L. The fan 60 is disposed in the aperture portion of the side plate.

According to the present embodiment, as shown by the arrow 101 of FIG. 9, the upper inner surface 57*a* of the duct frame 57 is inclined upward; accordingly, the heat 100 generated from the fixing device 9 moves obliquely upward along the upper inner surface 57*a* of the duct frame 55, and is discharged from the aperture portion 57*b* to the outside of the duct frame 57. And, by making outside air blow from the side surface of the printer 1 into the printer 1 by means of the fan 60 toward the aperture portion 57*b* and the sixth conveyance path 6L, or by exhaling air in the printer 1, it is possible to effectively cool the wasted heat from the aperture portion 57*b*. Besides, it is also possible to cool the sixth conveyance path L6; accordingly, it is also possible to cool, at the same time, the sheet that is conveyed in the six conveyance path L6 and delivered from the sheet delivery portion 50. Further, the duct frame 57 is formed of a sheet metal; accordingly, the heat radiation effect rises higher than the third embodiment that uses the duct frame 55 formed of a resin, and it is possible to raise the cooling efficiency higher.

Fifth Embodiment

Figure 10:
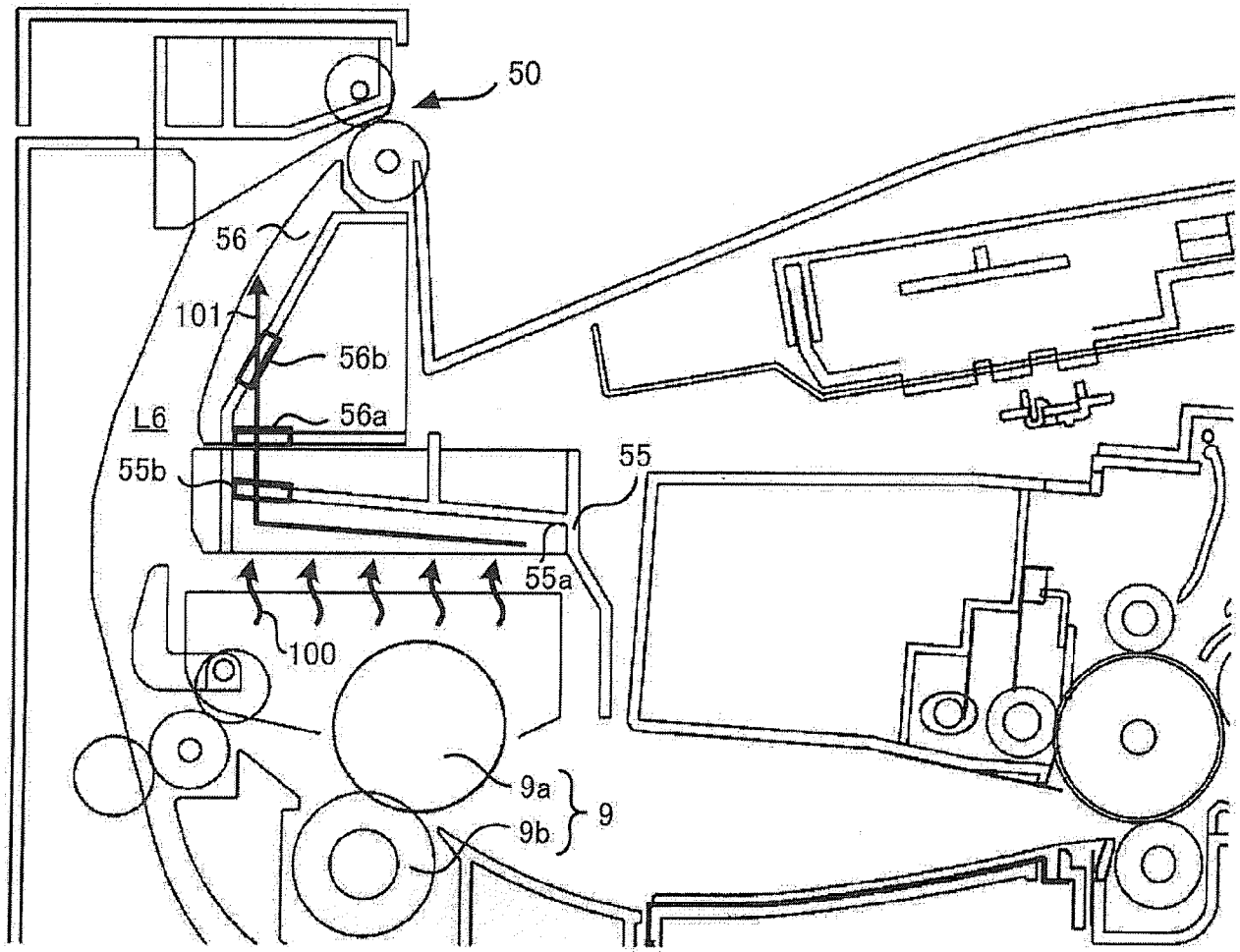
FIG. 10 is a left side sectional view showing a structure near a fixing device of an image forming apparatus according to a fifth embodiment.

FIG. 10 is a left side sectional view showing a structure near the fixing device 9 of an image forming apparatus (printer 1) according to a fifth embodiment.

The duct frame 55 is formed of a resin, mounted between two side plates (no shown) that are disposed to oppose each other, disposed right over the fixing device 9, and the lower surface is opened. The guide member 56 on the bent inner side of the sixth conveyance path L6 is disposed on the upper portion of the duct frame 55. The upper inner surface 55*a* of the duct frame 55 is inclined upward (in the side view of FIG. 5, the short-edge direction of the duct frame 57) in the short-edge direction of the duct frame 55 when seeing from the rotating shaft direction, and specifically, inclined to rise toward the sixth conveyance path L6.

The inclined upper end portion of the upper inner surface 55*a* of the duct frame 55 is provided with the aperture portion 55*b* from which the heat 100 generated from the fixing device 9 is discharged to the outside of the duct frame 55. It is possible to form the aperture portion 55*b* into, for example, a slit shape, and provide the aperture portion 55*b* at several places in the long-edge direction of the duct frame 55, namely, in the rotating shaft direction.

Besides, the guide member 56 is provided, at positions aligned with the aperture portion 55*b* in a vertical direction in a side view (side view when seeing from the rotating shaft direction) of FIG. 10, with aperture portions 56*a*, 56*b* from which the heat discharged from the duct frame 55 is discharged to the sixth conveyance path L6. For example, it is possible to form the aperture portions 56*a*, 56*b* into a slit shape, and provide the aperture portions 56*a*, 56*b* at several places in the long-edge direction of the duct frame 55.

According to the present embodiment, as shown by the arrow 101 of FIG. 10, the upper inner surface 55*a* of the duct frame 55 is inclined upward; accordingly, the heat 100 generated from the fixing device 9 moves obliquely upward along the upper inner surface 55*a* of the duct frame 55, and is discharged from the aperture portion 55*b* to the outside of the duct frame 55. Further, the heat discharged to the outside of the duct frame 55 is discharged from the aperture portions 56*a*, 56*b* to the sixth conveyance path L6. For example, the guide member 56 is provided with an aperture, and the heat is guided from this aperture to the sixth conveyance path L6. Or, the heat is guided to the sixth conveyance path L6 from a gap between the guide member 56 and another member adjacent to the guide member 56. In the six conveyance path L6, the sheet is conveyed, so that an air flow occurs in the same direction as the conveyance direction; accordingly, the heat, which is discharged from the aperture portions 56*a*, 56*b* to the sixth conveyance path L6, is discharged by the air flow to an outside of the printer 1. In this way, even if a fan is not disposed, it is possible to efficiently discharge the heat 100 generated from the fixing device 9 to the outside of the apparatus by means of natural air cooling.

Sixth Embodiment

Figure 11:
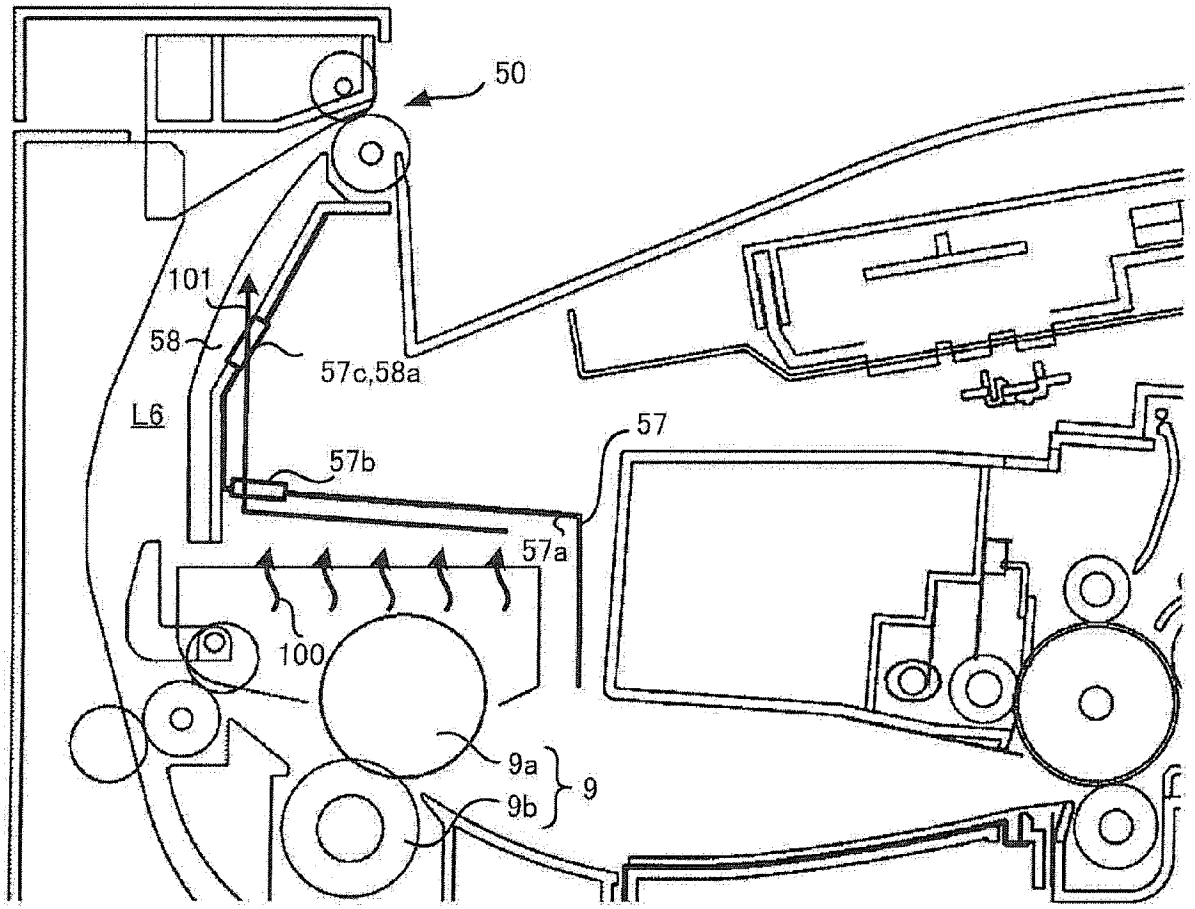
FIG. 11 is a left side sectional view showing a structure near a fixing device of an image forming apparatus according to a sixth embodiment.

FIG. 11 is a left side sectional view showing a structure near the fixing device 9 of an image forming apparatus (printer 1) according to a sixth embodiment.

The duct frame 57 is formed of a sheet metal, mounted between the two side plates (not shown) that are disposed to oppose each other, disposed right over the fixing device 9, and the lower surface is opened. The guide member 58 on the bent inner side of the sixth conveyance path L6 is disposed to cover the outer surface of the duct frame 57. The upper inner surface 57*a* of the duct frame 57 is inclined upward (side view of FIG. 5, in the short-edge direction of the duct frame 57) when seeing from the rotating shaft direction, and specifically, inclined to rise toward the sixth conveyance path L6.

The inclined upper end portion of the upper inner surface 57*a* of the duct frame 57 is provided with the aperture portions 57*b*, 57*c* from which the heat 100 generated from the fixing device 9 is discharged to the outside of the duct frame 57. It is possible to form the aperture portions 57*b*, 57*c* into, for example, a slit shape, and provide the aperture portions 57*b*, 57*c* at several places in the long-edge direction of the duct frame 57, namely, in the rotating shaft direction.

Besides, the guide member 58 is provided with an aperture portion 58*a* from which the heat discharged from the duct frame 57 is discharged to the sixth conveyance path L6. It is possible to form the aperture portion 58*a* into, for example, a slit shape, and provide the aperture portion 58*a* at several places in a long-edge direction of the guide member 58, namely, in the rotating shaft direction.

According to the present embodiment, the upper inner surface 57*a* of the duct frame 57 is inclined; accordingly, as shown by the arrow 101 of FIG. 11. the heat 100 generated from the fixing device 9 moves obliquely upward along the upper inner surface 57*a* of the duct frame 57, and is discharged from the aperture portions 57*b*, 57*c* to the outside of the duct frame 57. Further, the heat discharged to the outside of the duct frame 57 is discharged from the aperture portion 58*a* to the sixth conveyance path L6. For example, the guide member 58 is provided with an aperture, and the heat is guided from this aperture to the sixth conveyance path L6. Or, the heat is guided to the sixth conveyance path L6 from a gap between the guide member 58 and another member adjacent to the guide member 58. In the six conveyance path L6, the sheet is conveyed, so that an air flow occurs in the same direction as the conveyance direction; accordingly, the heat, which is discharged from the aperture portion 58*a* to the sixth conveyance path L6, is discharged by the air flow to the outside of the printer 1. In this way, even if a fan is not disposed, it is possible to efficiently discharge the heat 100 generated from the fixing device 9 to the outside of the apparatus by means of natural air cooling.

Seventh Embodiment

Figure 12:
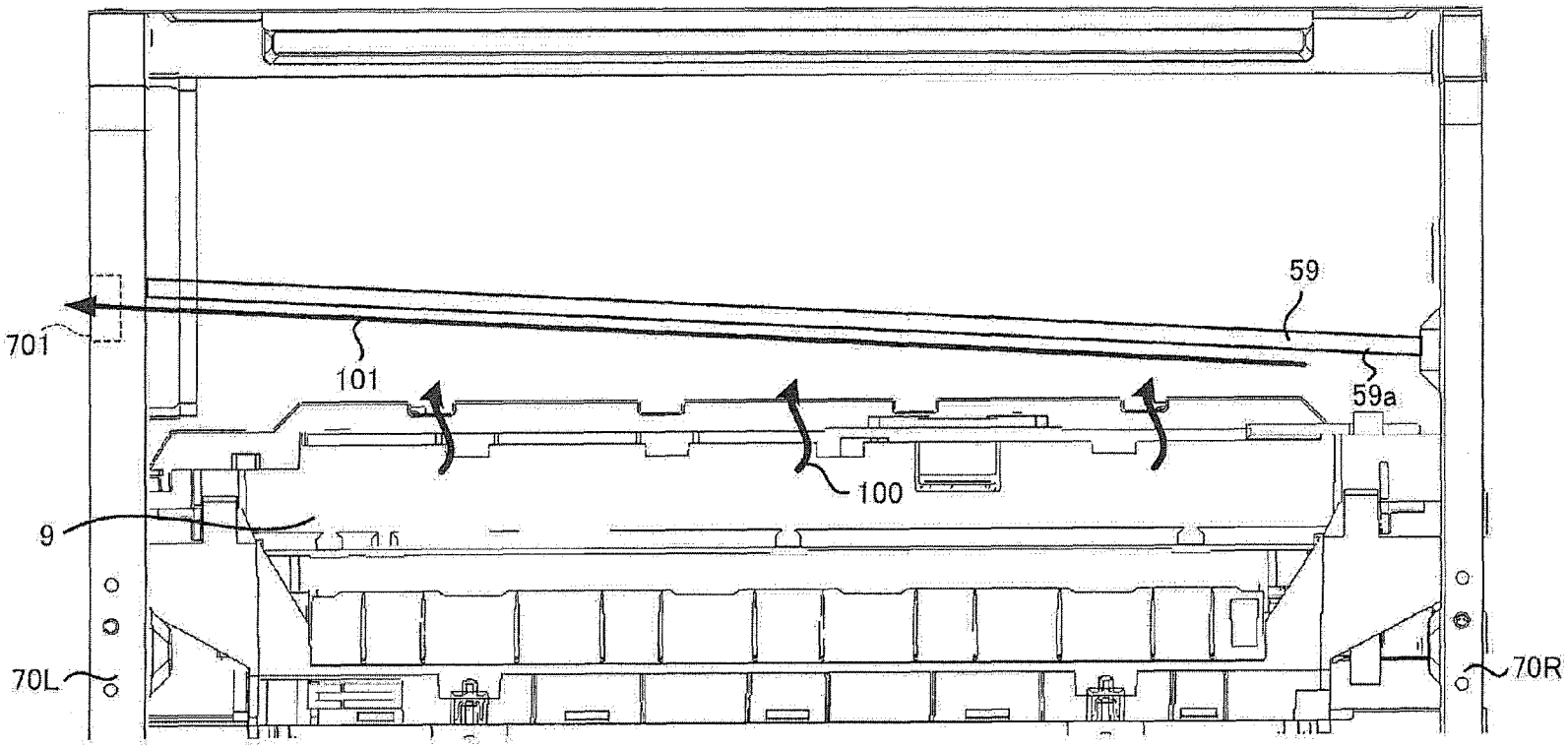
FIG. 12 is a front sectional view showing a structure near a fixing device of an image forming apparatus according to a seventh embodiment.

FIG. 12 is a front sectional view showing a structure near the fixing device 9 of an image forming apparatus (printer 1) according to a seventh embodiment.

A duct frame 59 is formed of a resin or a sheet metal. The duct frame 59 is mounted between the two side plates 70L, 70R that are disposed to oppose the respective sides in the rotating shaft direction of both rollers of the fixing device 9. The duct frame 59 is disposed right over the fixing device 9 and a lower surface is opened. An upper inner surface 59*a* of the duct frame 59 is inclined in a long-edge direction (the rotating shaft direction) of the duct frame 59. In other words, the upper inner surface 59*a* of the duct frame 59 has an inclination in a side view (side view shown in FIG. 12) when seeing from a direction perpendicular to the rotating shaft direction. Specifically, the upper inner surface 59*a* of the duct frame 59 is inclined to rise from the side plate 70R to the side plate 70L. The side plate 70L is provided with an aperture portion 701 that exposes at least an upper end surface of the duct frame 59.

In the meantime, in a case where the fixing device 9 does not have the heat roller 9*a* and the press roller 9*b*, for example, in a case where the fixing device 9 has another structure including a heat mechanism that is formed of a heat belt instead of heat roller 9*a*, the duct frame 59 is mounted between the two side plates 70L, 70R disposed at the respective sides that interpose the fixing device 9. Besides, the upper inner surface of the duct frame 59 is inclined in a direction extending to the sides of the fixing device 9.

According to the present embodiment, as shown by the arrow 101 of FIG. 12, the upper inner surface 59*a* of the duct frame 59 is inclined; accordingly, the heat 100 generated from the fixing device 9 moves obliquely upward along the upper inner surface 59*a* of the duct frame 59, and is discharged from an end portion of the aperture portion 701 of the duct frame 59 to an outside of the duct frame 59. In this way, it is possible to efficiently discharge the heat 100 generated from the fixing device 9 to the outside of the apparatus by means of natural air cooling.

In the meantime, the upper inner surface 59*a* of the duct frame 59 may be inclined to rise from the side plate 70L to the side plate 70R, and the side plate 70R may be provided with the aperture portion 701 that exposes at least the upper end surface of the duct frame 59.

Eighth Embodiment

Figure 13:
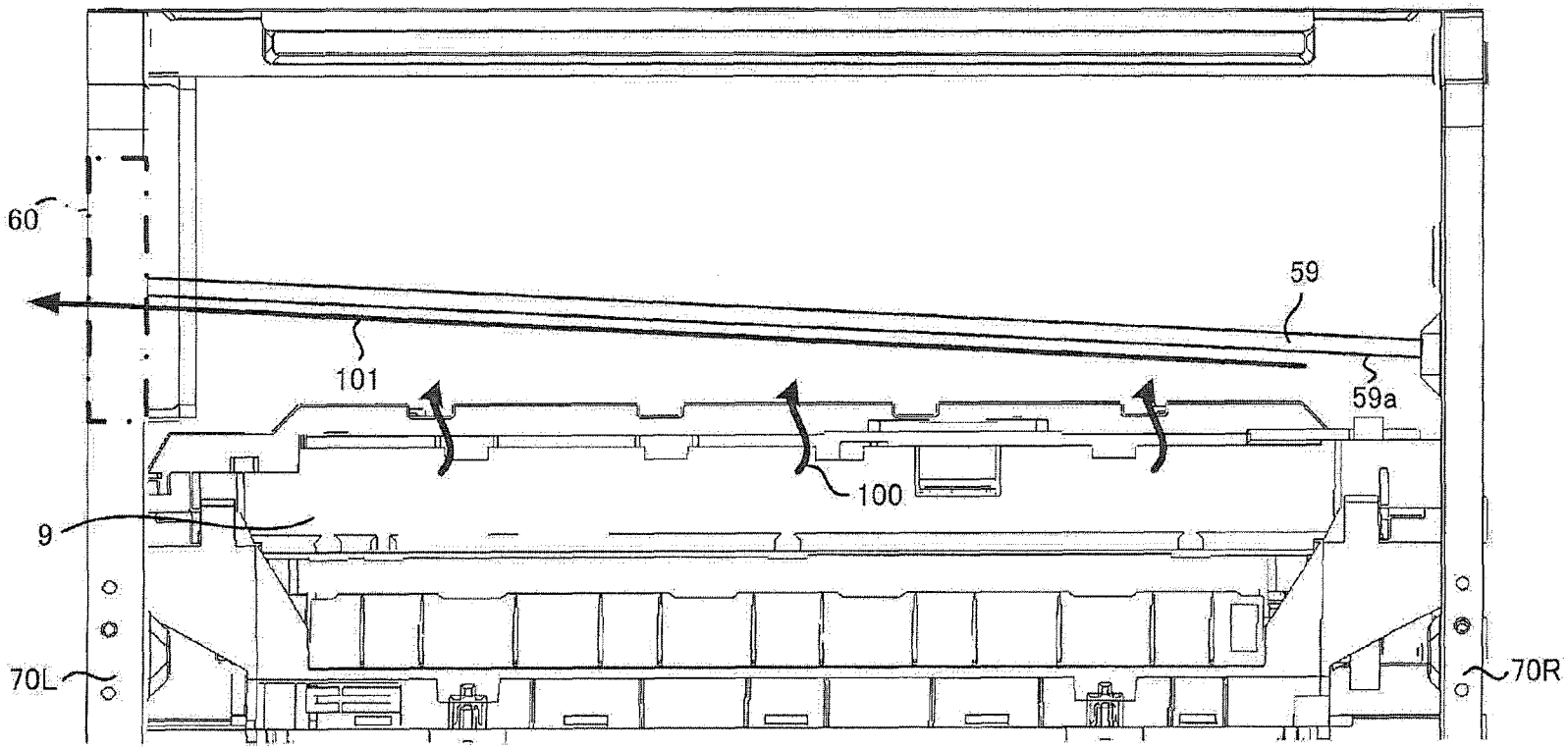
FIG. 13 is a front sectional view showing a structure near a fixing device of an image forming apparatus according to an eighth embodiment.
Figure 14:
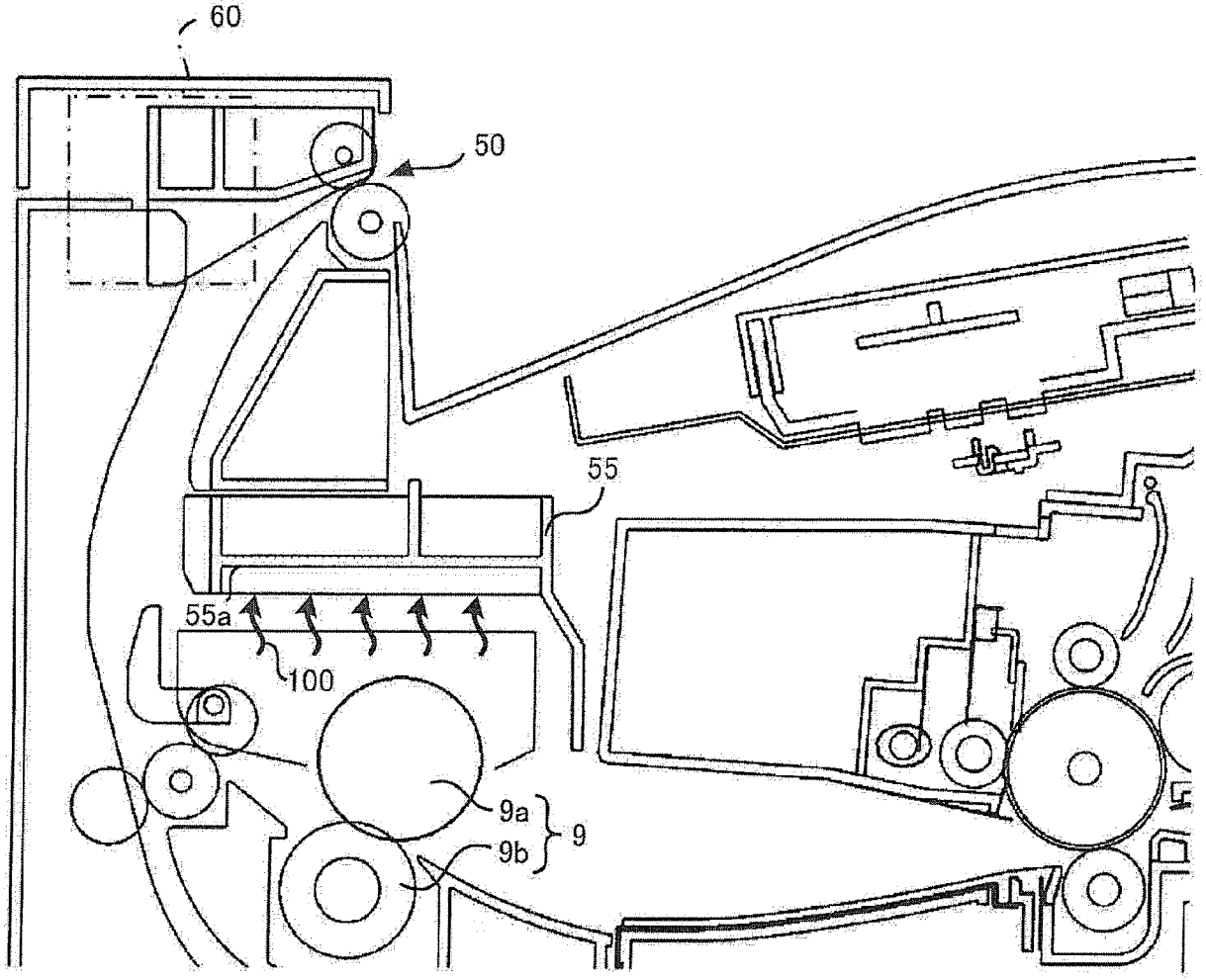
FIG. 14 is a left side sectional view showing a structure near a fixing device of a conventional image forming apparatus.

FIG. 13 is a front sectional view showing a structure near the fixing device 9 of an image forming apparatus (printer 1) according to an eighth embodiment.

The duct frame 59 is formed of a resin or a sheet metal, mounted between the two side plates 70L, 70R that are disposed to oppose each other, disposed right over the fixing device 9, and the lower surface is opened. The upper inner surface 59*a* of the duct frame 59 is inclined in the long-edge direction of the duct frame 59, and specifically, inclined to rise from the side plate 70R to the side plate 70L. The side plate 70L is provided with an aperture portion that exposes at least an upper end surface of the duct frame 59.

The fan 60 is disposed in the aperture portion of the side plate 70L. The fan 60 has a blade and its rotation mechanism that generate an air flow to discharge the heat staying in the duct frame 59 to the outside of the printer 1.

According to the present embodiment, as shown by the arrow 101 of FIG. 13, the upper inner surface 59*a* of the duct frame 59 is inclined; accordingly, the heat 100 generated from the fixing device 9 moves obliquely upward along the upper inner surface 59*a* of the duct frame 59, and is forcibly discharged by the fan 60 from the open-side end portion of the duct frame 59 to the outside of the duct frame 59. In this way, it is possible to efficiently discharge the heat 100 generated from the fixing device 9 to the outside of the apparatus by means of forcible air cooling.

In the meantime, the upper inner surface 59*a* of the duct frame 59 may be inclined to rise from the side plate 70L to the side plate 70R, and the side plate 70R may be provided with the aperture portion and the fan 60 that expose at least the upper end surface of the duct frame 59.

Besides, in the above first to fourth embodiments and eighth embodiment, the fan 60 may be operated during a continuous sheet feeding period only. For example, printer 1 has a control portion 200 (FIG. 1) that is responsible for comprehensive control of the printer 1, and the control portion 200 drives and controls the fan 60. The control portion 200 makes the fan 60 operate only when the printer 1 performs the continuous sheet feeding operation.

The reason for this operation is that during the continuous sheet feeding period, the heat roller 9*a* of the fixing device 9 continues to be heated for a long time, so that the heat amount generated from the fixing device 9 increases, while during an only-one sheet feeding period, the heating period of the heat roller 9*a* is short and the heat amount generated from the fixing device 9 becomes small; accordingly, it is not necessary to forcibly perform air cooling by means of the fan 60. In this way, it is possible to make the period for operating the fan 60 shorter, and achieve energy saving and low noise.

Hereinbefore, the embodiments of the present disclosure are described; however, the present disclosure is not limited to the structures of the above embodiments, but various modifications are possible. For example, in the above embodiments, the printer 1 is used and described as an embodiment of the image forming apparatus according to the present disclosure; however, this is a mere example, and other image forming apparatuses, for example, other electronic apparatuses such as a copy machine, a facsimile device, a multifunctional machine and the like may be used.

Besides, in the above embodiments, the structures described in the above embodiments by using FIG. 1 to FIG. 13 are mere embodiments of the present disclosure, and it is not intended to limit the present disclosure to the above structures. For example, in combinations of the first to sixth embodiments, seventh and eighth embodiments, the upper inner surface of the duct frame may be inclined upward in the direction extending toward the side and in the direction extending upward when seeing from the side. Besides, also in this case, any one of the two side plates may be provided with an aperture portion that exposes at least the open-side end surface of the duct frame. Besides, it is preferable to provide the inclined upper end portion of the upper inner surface inclined upward when seeing from the side with an aperture portion from which the heat generated from the fixing device is discharged to the outside of the duct frame, and more preferable to dispose a fan in the aperture portion of the side plate.

As described above, according to the present disclosure, by means of the inclination of the duct frame, without using a fan as an essential mechanism, it becomes possible to efficiently discharge the heat generated from the fixing device in the image forming apparatus to the outside of the apparatus. In this way, the heat does not stay in the frame duct; accordingly, it becomes unnecessary to form the frame duct with a heat-resistant resin, besides, a fan is not an essential mechanism; accordingly, it is possible to reduce the cost.

What is claimed is:

1. An image forming apparatus comprising:

an image carrier on a surface of which a toner image is developed, a transfer device that transfers the toner image from the image carrier to a sheet, a fixing device that fixes the toner image to the sheet by heating and pressing the sheet to which the toner image is transferred, a duct frame that is mounted between two side plates disposed at respective sides which interpose the fixing device and is disposed right over the fixing device with a lower surface opened, a sheet delivery portion that is disposed above the fixing device and delivers the sheet to which the toner image is fixed to an outside of the image forming device, and a bent conveyance path that guides the sheet delivered from the fixing to the sheet delivery portion, wherein an upper inner surface of the duct frame is inclined upward when seeing from the side, and an inclined upper end portion of the upper inner surface is provided with an aperture portion that discharges heat generated from the fixing device to an outside of the duct frame, the upper inner surface of the duct frame is inclined upward as approaching the conveyance path, and a guide member disposed on an inner side of a bent portion of the conveyance path is provided with an aperture portion that discharges heat, which is discharged from the duct frame, to the conveyance path.

2. The image forming apparatus according to claim 1, wherein the fixing device has a heat roller and a press roller, the duct frame is mounted between the two side plates which are disposed to oppose the respective sides in a rotating shaft direction of both the rollers with the fixing device interposed between the respective side, and the upper inner surface of the duct frame is inclined upward when seeing from the rotating shaft direction between the sides.

3. The image forming apparatus according to claim 1, wherein any one of the two side plates is provided with an aperture portion that exposes at least a side end surface of the inclined upper end portion of the upper inner surface of the duct frame and a side end surface of the conveyance path, and a fan is disposed at the aperture portion of the side plate.

4. The image forming apparatus according to claim 3, further comprising:

a control portion that controls operation of the fan, wherein the control portion makes the fan operate during a continuous sheet feeding period only.

5. An image forming apparatus comprising:

an image carrier on a surface of which a toner image is developed, a transfer device that transfers the toner image from the image carrier to a sheet, a fixing device that fixes the toner image to the sheet by heating and pressing the sheet to which the toner image is transferred, and a duct frame that is mounted between two side plates disposed at respective sides which interpose the fixing device and is disposed right over the fixing device with a lower surface opened, a drum cleaning device that removes toner remaining on a surface of the image carrier, and a wasted toner portion that accumulates the toner removed by the drum cleaning device, wherein an upper inner surface of the duct frame is inclined upward when seeing from the side, and an inclined upper end portion of the upper inner surface is provided with an aperture portion that discharges heat generated from the fixing device to an outside of the duct frame, the wasted toner portion is disposed adjacently to the fixing device, the upper inner surface of the duct frame is inclined to rise toward the wasted toner portion, any one of the two side plates is provided with an aperture portion that exposes at least a side end surface of the inclined upper end portion of the upper inner surface of the duct frame and a side end surface of the wasted toner portion, and a fan is disposed at the aperture portion of the side plate.

6. The image forming apparatus according to claim 5, further comprising:

a control portion that controls operation of the fan, wherein the control portion makes the fan operate during a continuous sheet feeding period only.

7. The image forming apparatus according to claim 5, further comprising:

a control portion that controls operation of the fan, wherein the control portion makes the fan operate during a continuous sheet feeding period only.

8. An image forming apparatus comprising:

an image carrier on a surface of which a toner image is developed, a transfer device that transfers the toner image from the image carrier to a sheet, a fixing device that fixes the toner image to the sheet by heating and pressing the sheet to which the toner image is transferred, a duct frame that is mounted between two side plates disposed at respective sides which interpose the fixing device and is disposed right over the fixing device with a lower surface opened, a sheet delivery portion that is disposed above the fixing device and delivers the sheet to which the toner image is fixed to an outside of the image forming apparatus, and a bent conveyance path that guides the sheet delivered from the fixing device to the sheet delivery portion, wherein an upper inner surface of the duct frame is inclined upward in a direction extending toward the side and in a direction extending upward when seeing from the side, and any one of the two side plates is provided with an aperture portion that exposes at least an open-side end surface of the duct frame, the upper inner surface of the duct frame is inclined upward as approaching the conveyance path, and a guide member disposed on an inner side of a bent portion of the conveyance path is provided with an aperture portion that discharges heat, which is discharged from the duct frame, to the conveyance path.

9. The image forming apparatus according to claim 8, wherein a fan is disposed at the aperture portion of the side plate.

10. An image forming apparatus comprising:

an image carrier on a surface of which a toner image is developed, a transfer device that transfers the toner image from the image carrier to a sheet, a fixing device that fixes the toner image to the sheet by heating and pressing the sheet to which the toner image is transferred, a duct frame that is mounted between two side plates disposed at respective sides which interpose the fixing device and is disposed right over the fixing device with a lower surface opened, a drum cleaning device that removes toner remaining on a surface of the image carrier, and a wasted toner portion that accumulates the toner removed by the drum cleaning device, wherein an upper inner surface of the duct frame is inclined upward in a direction extending toward the side and in a direction extending upward when seeing from the side, and any one of the two side plates is provided with an aperture portion that exposes at least an open-side end surface of the duct frame, the wasted toner portion is disposed adjacently to the fixing device, the upper inner surface of the duct frame is inclined to rise toward the wasted toner portion, and a fan is disposed at the aperture portion of the side plate.

* * * * *